US008346108B2

(12) United States Patent
Jeong

(10) Patent No.: US 8,346,108 B2
(45) Date of Patent: Jan. 1, 2013

(54) IMAGE FORMING APPARATUS

(75) Inventor: Yoo Hung Jeong, Suwon-si (KR)

(73) Assignee: Samsung Electronics Co., Ltd., Suwon (KR)

( * ) Notice: Subject to any disclaimer, the term of this patent is extended or adjusted under 35 U.S.C. 154(b) by 295 days.

(21) Appl. No.: 12/923,221

(22) Filed: Sep. 9, 2010

(65) Prior Publication Data

US 2011/0064434 A1 Mar. 17, 2011

(30) Foreign Application Priority Data

Sep. 16, 2009 (KR) ..... 10-2009-0087392

(51) Int. Cl.
*G03G 15/00* (2006.01)

(52) U.S. Cl. ..... 399/48; 399/26; 399/73; 399/110

(58) Field of Classification Search ..... 399/26, 399/48, 73, 110
See application file for complete search history.

(56) References Cited

U.S. PATENT DOCUMENTS 5,978,626 A * 11/1999 Nagamine et al. ..... 399/125
6,144,811 A * 11/2000 Ohori et al. ..... 399/9
2006/0263108 A1* 11/2006 Zona ..... 399/48

* cited by examiner

*Primary Examiner* — Joseph S Wong
(74) *Attorney, Agent, or Firm* — Staas & Halsey LLP

(57) ABSTRACT

Disclosed herein is an image forming apparatus capable of avoiding positional interference between an electrical potential sensor and a developing device during the installation or separation of the developing device. The positional interference is prevented by moving the electrical potential sensor out of the movement path of the developing device in association with the opening/closing movement a cover for an access opening in the body of the image forming apparatus for the installation/separation of the developing device. A link device connects the cover and the electrical potential sensor to each other so as to cause the movement of the electrical potential sensor in linkage with the opening/closing of the cover. The link device serves as an anti-interference device that prevents the positional interference between the developing device and the electrical potential sensor.

20 Claims, 6 Drawing Sheets

IMAGE FORMING APPARATUS

CROSS-REFERENCE TO RELATED APPLICATION

This application claims the benefit of Korean Patent Application No. 10-2009-0087392, filed on Sep. 16, 2009 in the Korean Intellectual Property Office, the disclosure of which is incorporated herein by reference.

TECHNICAL FIELD

The present disclosure relate generally to an image forming apparatus having a movable electrical potential sensor.

BACKGROUND OF RELATED ART

Generally, image forming apparatuses are devised to form an image on a printing medium according to received image signals. Examples of image forming apparatuses include printers, copiers, facsimiles, and so-called multi-functional devices that combine some of the functionalities of the aforementioned devices.

In operation of an image forming apparatus, light is irradiated to a photosensitive body of a developing device that has been charged to a predetermined electrical potential, so as to form an electrostatic latent image on the surface of the photosensitive body. As toner, which is an example of developer, is supplied to the electrostatic latent image, a visible toner image is formed. The toner image formed on the photosensitive body is directly transferred to a printing medium or is indirectly transferred to the printing medium by way of an intermediate transfer body. The transferred image is fused to the printing medium via a fusing process.

The image forming apparatus further includes an electrical potential sensor to measure an electrical potential of the surface of the photosensitive body.

The developing device is separably mounted in the body of the image forming apparatus. When the electrical potential sensor is arranged close to the photosensitive body of the developing device, there may occur positional interference between the developing device and the electrical potential sensor during the installation or the separation of the developing device.

SUMMARY OF DISCLOSURE

Therefore, it is an aspect of the present disclosure to provide an image forming apparatus capable of preventing the positional interference between an electrical potential sensor and a developing device during the installation and/or the separation of the developing device.

Additional aspects of the invention will be set forth in part in the description which follows and, in part, will be apparent from the description, or may be learned by practice of embodiments of the invention.

In accordance with one aspect of the present invention, there may be provided an image forming apparatus that may include a body, a developing device, an electrical potential sensor unit and a cover. The developing device may be separably received in the body, and may include a photosensitive body. The electrical potential sensor unit may be arranged to measure an electrical potential of a surface of the photosensitive body. The cover may be arranged to open and close an access opening provided in the body, through which access opening the developing device is received into and separated from the body. The electrical potential sensor unit may be movable in association with opening/closing movement of the cover.

The image forming apparatus may further comprise a link device to couple the cover and the electrical potential sensor unit to each other. The link device may be rotatable according to the opening/closing movement of the cover.

The link device may include a first link member coupled to the cover and a second link member having one end thereof coupled to the first link member and the other end thereof coupled to the electrical potential sensor unit. The second link member may be rotatable about a spatial position inside the body.

The link device may include a first hinge that rotatably couples one end of the first link member to the cover, a second hinge that rotatably couples the other end of the first link member to one end of the second link member and a third hinge that rotatably couples a portion of the second link member to the spatial position inside the body.

The first link member may include a bent portion positioned adjacent the spatial position inside the body.

The second link member may include a bent portion. The third hinge may be coupled to the bent portion.

The second link member may include a first extension extending from the second hinge to the bent portion and a second extension extending from the bent portion to the electrical potential sensor unit. The first extension may be shorter in length than the second extension.

The second extension may include an access portion protruding from an end thereof toward the photosensitive body. The electrical potential sensor unit may be coupled to the access portion.

The cover may be arranged at an upper front portion of the body. The image forming apparatus may further comprise a fourth hinge that rotatably couples the cover to the body.

The electrical potential sensor unit may include a sensor configured to measure the electrical potential of the surface of the photosensitive body and an electrical potential sensor housing coupled to the second link member. The sensor may be receive in, and supported by, the electrical potential sensor housing.

The link device may be arranged adjacent a light scanning unit that is configured to produce light to be incident upon the surface of the photosensitive body.

According to another aspect of the present disclosure, an image forming apparatus may be provided to include a body, a photosensitive body, a developing device, an electrical potential sensor unit and an anti-interference device. The photosensitive body may have a surface on which an electrostatic latent image is to be formed and developed. The developing device may be detachably received in the body, and may be configured to supply developer to the photosensitive body so as to develop the electrostatic latent image on the surface of the photosensitive body. The electrical potential sensor unit may be arranged to measure an electrical potential of a surface of the photosensitive body. The anti-interference device may be adapted to cause the electrical potential sensor unit to move out of a movement path of the developing device along which the developing device moves during installation or detachment of the developing device to thereby prevent an interfering contact between the developing device and the electrical potential sensor unit during movement of the developing device along the movement path.

The image forming apparatus may further comprise a cover arranged to open and close an access opening provided in the body, through which access opening the developing device is installed into and detached from the body. The anti-interference device may couple the cover and the electrical potential sensor unit together in such a manner the electrical potential sensor unit moves in association with the opening/closing movement of the cover.

The anti-interference device may comprise a link device that rotates in association with the opening/closing movement of the cover.

According to yet another aspect of the present disclosure, an image forming apparatus may be provided to include a body, a cover arranged to open and close an access opening in the body, a developing device, an electrical potential sensor unit and a link device. The developing device may include a photosensitive body, and may be receivable into and detachable from the body through the access opening. The electrical potential sensor unit may be configured to measure an electrical potential of a surface of the photosensitive body. The link device may be adapted to couple the cover and the electrical potential sensor unit in such a manner the electrical potential sensor unit moves toward or away from the photosensitive body according to opening/closing movement of the cover.

The link device may include a first link member coupled to the cover and a second link member having one end thereof coupled to the first link member and the other end thereof coupled to the electrical potential sensor unit. The second link member may be rotatable about a spatial position inside the body.

The link device may include a first hinge rotatably coupling one end of the first link member to the cover, a second hinge rotatably coupling the other end of the first link member to one end of the second link member and a third hinge rotatably coupling a portion of the second link member to the spatial position inside the body.

The first link member may include a first bent portion formed at a position intermediate the two ends thereof. The second link member may include a second bent portion. The third hinge may be coupled to the second bent portion.

The second link member may include a first extension extending from the second hinge to the second bent portion and a second extension extending from the second bent portion to the electrical potential sensor unit. The first extension may be shorter in length than the second extension.

The second extension may include an access portion protruding from an end thereof toward the photosensitive body. The electrical potential sensor unit may be coupled to the access portion.

BRIEF DESCRIPTION OF THE DRAWINGS

Various features and advantages of the disclosure will become more apparent by the following detailed description of several embodiments thereof with reference to the attached drawings, of which.

DETAILED DESCRIPTION OF SEVERAL EMBODIMENTS

Figure 1:
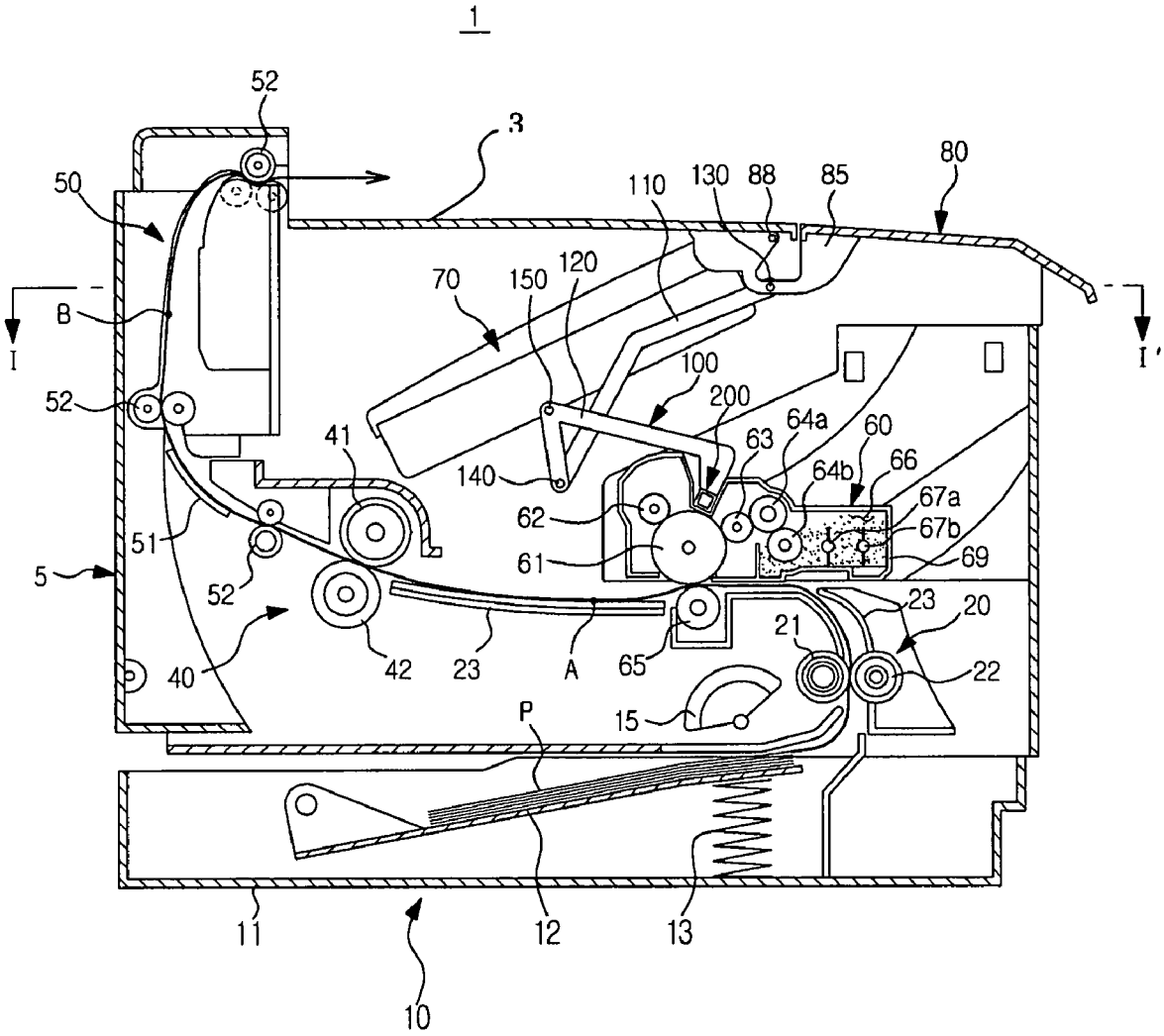
FIG. 1 is a schematic illustration of an internal configuration of an image forming apparatus according to an embodiment of the present disclosure.

Reference will now be made in detail to the embodiments of the present disclosure, in reference to the accompanying drawings, wherein like reference numerals refer to like elements throughout.

FIG. 1 is a view illustrating the internal configuration of an image forming apparatus according to an embodiment of the present disclosure.

As shown in FIG. 1, the image forming apparatus 1 according to an embodiment may include a body 5, a paper supply device 10 in which paper P is loaded, a delivery device 20 arranged to deliver the paper P, a developing device 60 configured to form an image on the paper P delivered from the paper supply device 10, a fusing device 40 to fuse the image onto the paper P, a paper discharge device 50 to discharge the paper P, and a cover 80 provided open and close the top portion of the front surface of the body 5.

The paper supply device 10 serves to supply the paper P, and may be arranged in the lower portion of the body 5. The paper supply device 10 may include a paper supply tray 11 receivable into the body 5 as a detachable cassette and a press plate 12 elastically supported by a press spring 13 so as to push the paper P loaded in the paper supply tray 11 upward in the direction of a pickup roller 15. The press spring 13 may be mounted below the press plate 12, and may serve to push the press plate 12 toward the pickup roller 15. The pickup roller 15 is adapted to pick up the paper P sheet by sheet via rotation thereof, and to supply the picked up paper P to the delivery device 20.

The delivery device 20 serves to deliver the paper P that is picked up by the pickup roller 15 along a printing path A. The delivery device 20 may include a delivery roller 21, a delivery backup roller 22 and a delivery guide 23 defining a portion of the printing path A.

The developing device 60 may be separably mounted in the body 5. The developing device 60 may include a photosensitive body 61 arranged along the printing path A, on a surface of which an electrostatic latent image is to be formed, a charging roller 62 configured to charge the photosensitive body 61 to a predetermined electrical potential, a developing roller 63 operable to supply developer to the electrostatic latent image formed on the photosensitive body 61 so as to form a visible image, supply rollers 64*a* and 64*b* arranged to supply the developer to the developing roller 63, a developer reservoir 66 to receive the developer therein, developer agitators 67*a* and 67*b* mounted in the developer reservoir 66 to agitate the developer and a housing 69 defining an exterior appearance of the developing device 60.

A transfer device may be arranged along the printing path A so as to transfer the image formed on the photosensitive body 61 to the paper P. By way of an example, the transfer device may comprise a transfer roller 65 opposingly facing the photosensitive body 61.

A Light Scanning Unit (LSU) 70 may be provided in the body 5, and may serve to form the electrostatic latent image by irradiating light, such as, for example, laser beam containing the image information, to the charged photosensitive body 61.

In the state wherein the photosensitive body 61 is charged by the charging roller 62, the electrostatic latent image is formed on the surface of the photosensitive body 61 as the light scanning unit 70 irradiates laser beam to the surface of the photosensitive body 61. The developing roller 63 acts to attach the developer to the electrostatic latent image of the photosensitive body 61, forming a visible image. The transfer roller 65 transfers the developer attached to the photosensitive body 61 to the paper P.

An electrical potential sensor unit 200 may be provided above the photosensitive body 61, and may be coupled to the cover 80 by the use of a link device 100. The electrical potential sensor unit 200 may be arranged to move according to the opening/closing movement of the cover 80, which aspect will be described later in greater detail.

The fusing device 40 may include a heating roller 41 and a press roller 42. As heat and/or pressure are applied to the developer forming the image transferred to the paper P while the paper P passes through a gap between the heating roller 41 and the press roller 42, the developer becomes fused to the paper P.

The paper discharge device 50 delivers the paper P that has passed through the fusing device 40 to a paper discharge portion 3 located at the top of the body 5. The paper discharge device 50 may include paper discharge guides 51 to guide the paper P toward the paper discharge portion 3 and a plurality of paper discharge rollers 52 arranged along a paper discharge path B.

The cover 80 according to an embodiment may be provided to open and close to the top front portion of the body 5, and may be coupled to the body 5 through a connector 85. The connector 85 is hingedly coupled to the body 5 via a fourth hinge 88 so as to move integrally move with the cover 80 during the opening/closing of the cover 80.

Hereinafter, the electrical potential sensor unit 200 and the link device 100 used to connect the electrical potential sensor unit 200 to the cover 80 will be described in greater detail.

Figure 2:
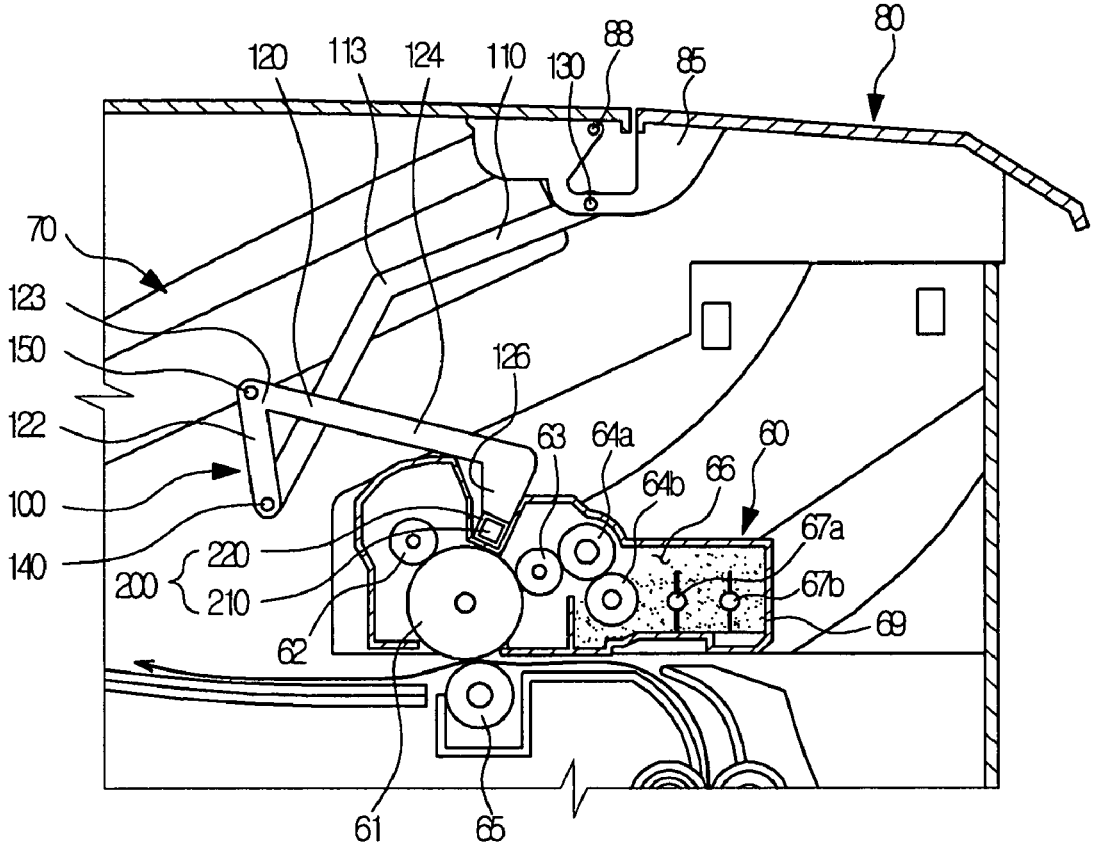
FIG. 2 is a detailed sectional view illustrating an electrical potential sensor unit and a link device according to an embodiment of the present disclosure.
Figure 3:
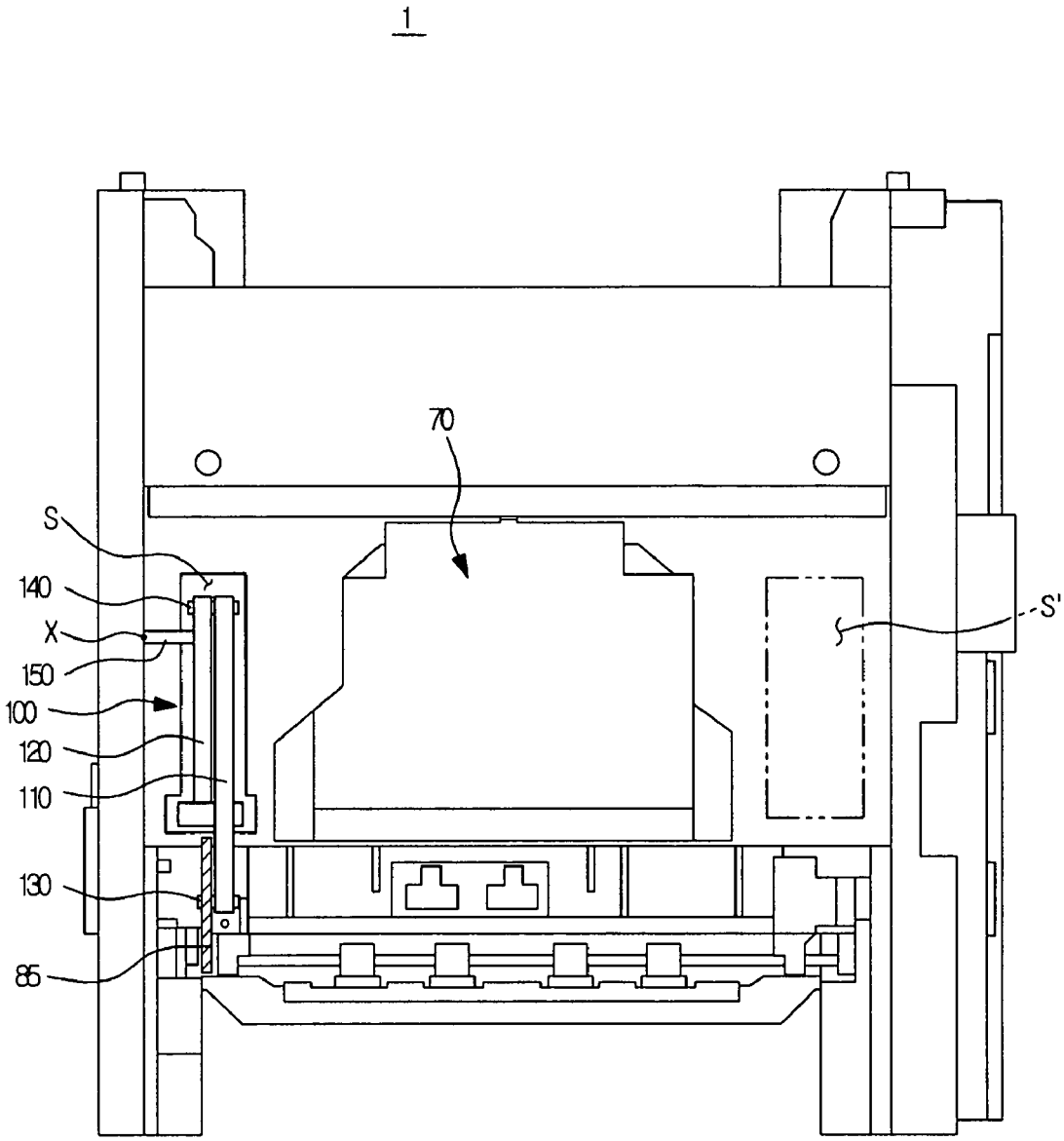
FIG. 3 is a sectional view taken along the line I-I' of FIG. 1.

FIG. 2 is a detailed sectional view illustrating the electrical potential sensor unit and the link device according to an embodiment of the present disclosure, whereas FIG. 3 is a sectional view taken along the line I-I' of FIG. 1.

The electrical potential sensor unit 200 may include an electrical potential sensor 210 adapted to measure the electrical potential of the surface of the photosensitive body 61 and an electrical potential sensor housing 220 in which the electrical potential sensor 210 is received.

The electrical potential sensor 210 is arranged close to the photosensitive body 61 in order to accurately measure the electrical potential of the surface of the photosensitive body 61. The distance between the electrical potential sensor 210 and the photosensitive body 61 may be, for example, 3 mm or less.

The electrical potential sensor housing 220 serves to enclose and to receive therein the electrical potential sensor 210, and is connected to the link device 100.

The link device 100 connects the cover 80 and the electrical potential sensor unit 200 to each other, and may be rotatable in association or cooperation with the opening/closing movement of the cover 80 so as to enable movement of the electrical potential unit sensor 200.

The link device 100 according to an embodiment may be arranged in an installation space S within the body 5. The installation space S is a space next to the light scanning unit 70. That is, an empty space next to the light scanning unit 70 is utilized as the installation space S. Although the installation space S may be positioned at the left side of the light scanning unit 70 as shown in FIG. 3, of course, the space at the right side of the light scanning unit 70 may alternatively be utilized as an installation space S'.

The link device 100 includes a first link member 110 connected to the cover 80 through the connector 85, and further includes a second link member 120 having one end connected to the first link member 110 and the other end connected to the electrical potential sensor unit 200, the second link member 120 being rotatable about the position X (see FIG. 3) inside the body 5.

When the first link member 110 is pulled by the cover 80, the second link member 120 connected to the first link member 110 acts to lift the electrical potential sensor unit 200 via the rotation thereof.

The connector 85 of the cover 80 and one end of the first link member 110 are hingedly coupled to each other via a first hinge 130 so as to be rotatable relative to each other. The other end of the first link member 110 and one end of the second link member 120 are hingedly coupled to each other via a second hinge 140 so as to be rotatable relative to each other. The second link member 120 is hingedly coupled to the internal position X of the body 5 via a third hinge 150 so as to be rotatable about the position X.

Accordingly, as force generated via opening/closing of the cover 80 is transmitted to the first link member 110 via the first hinge 130, the first link member 110 acts to pull one end of the second link member 120 via the second hinge 140, causing the second link member 120 to be rotated about the third hinge 150 coupled to the body 5 so as to lift the electrical potential sensor unit 200.

The first link member 110 includes a first bent portion 113 at the center thereof. This bent configuration allows the force of the opening/closing of the cover 80 to be transmitted effectively to the second link member 120, enabling the rotation of the second link member 120.

The second link member 120 includes a second bent portion 123 near the third hinge 150 coupled to the body 5.

The second link member 120 includes a first part 122 extending from the second hinge 140 to the second bent portion 123, and further includes a second part 124 extending from the second bent portion 123 to the electrical potential sensor unit 200. According to an embodiment, the first part 122 may be shorter than the second part 124.

The second part 124 includes an access portion 126 protruding from a distal end thereof toward the photosensitive body 61. The electrical potential sensor unit 200 is coupled to an end of the access portion 126. The access portion 126 is configured to connect the second link member 120 to the electrical potential sensor unit 200, and also to allow the electrical potential sensor unit 200 to easily access the photosensitive body 61.

Hereinafter, movement of the electrical potential sensor unit 200 according to opening/closing motion of the cover 80 will be described in greater detail.

Figure 4:
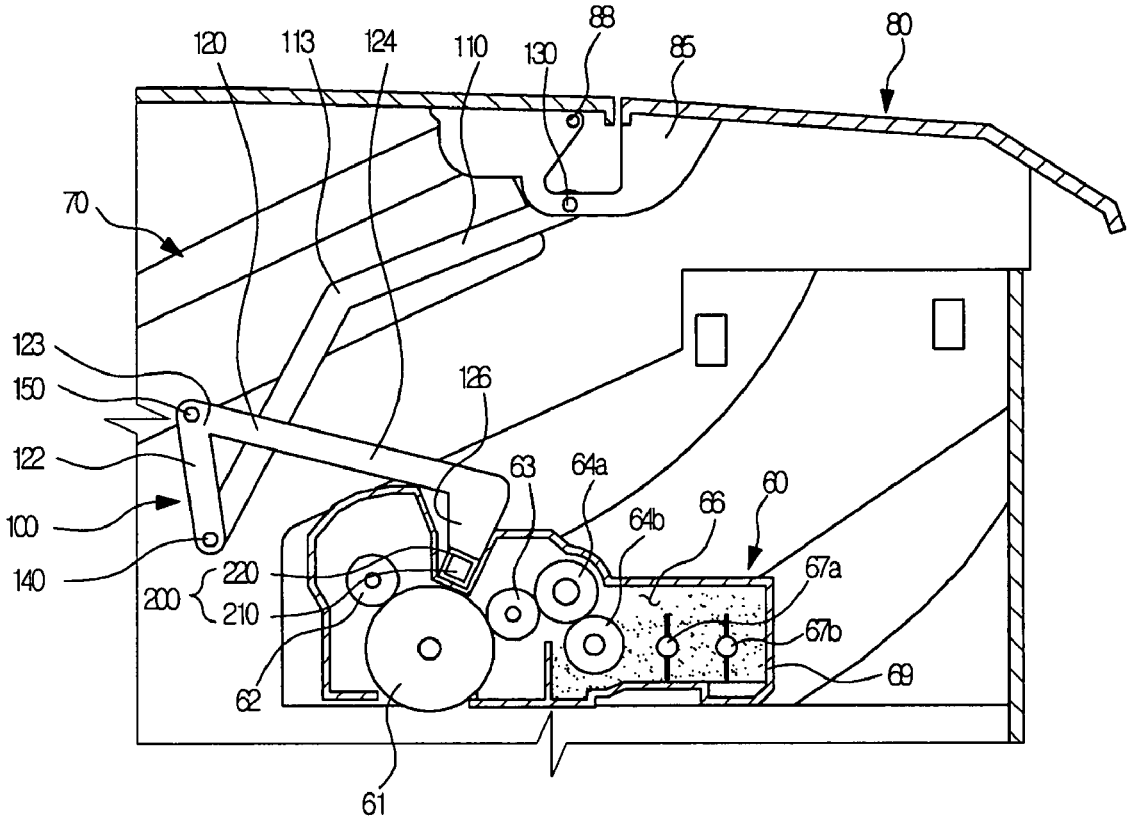
FIGS. 4 to 6 are detailed sectional views illustrating operations of the electrical potential sensor unit and the link device according to the opening/closing movement of a cover according to embodiments of the present disclosure.
Figure 5:
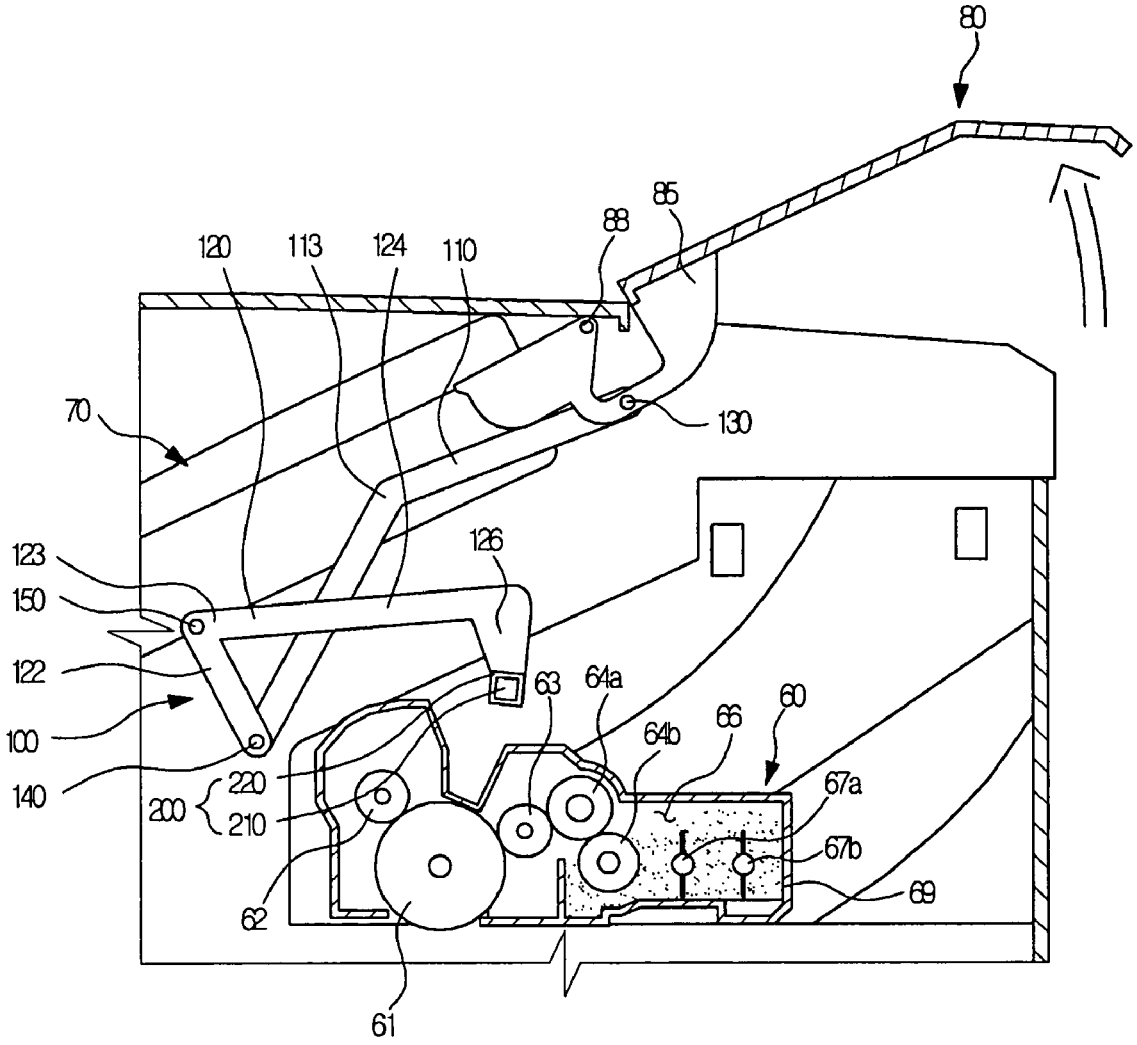
Figure 6:
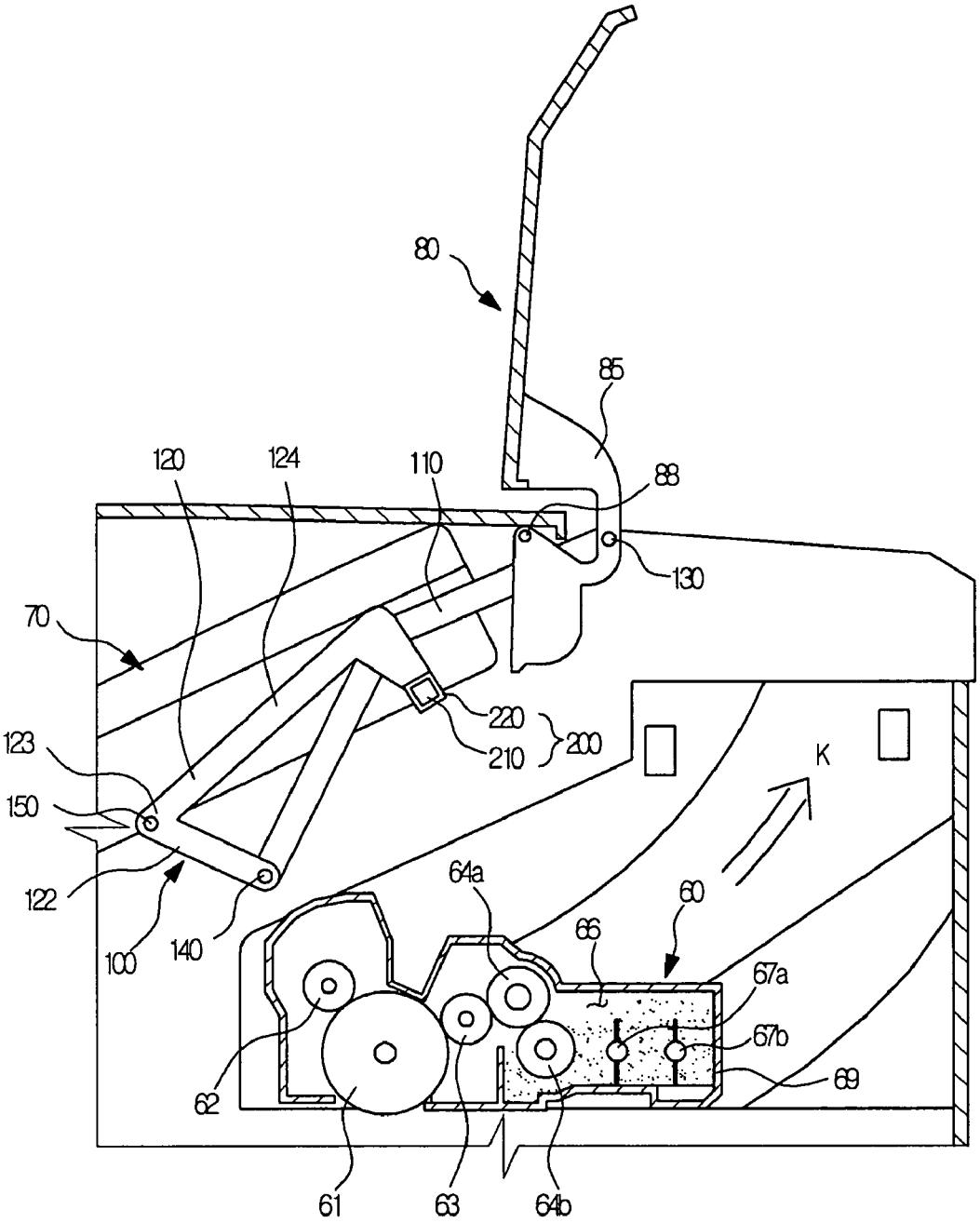

FIGS. 4 to 6 are detailed sectional views illustrating the operations of the electrical potential sensor unit and the link device according to the opening/closing movement of the cover.

As shown in FIG. 4, the electrical potential sensor unit 200 including the electrical potential sensor 210 is arranged close to the photosensitive body 61 when the cover 80 is closed, and functions to measure an electrical potential of the surface of the photosensitive body 61.

When replacing or servicing of the developing device 60 is necessary during use of the image forming apparatus 1 or when paper jam occurs in the image forming apparatus 1, the cover 80 is pulled upward and away from the body 5 so as to be opened as shown in FIG. 5. Also as shown in FIG. 5, the opening of the cover 80 causes the first link member 110 connected to the connector 85 to be pulled. The link member 110 converts the upward movement force of the cover 80 into counterclockwise rotational force of the first part 122 of the second link member 120. The second part 124 integrally coupled with the first part 122 is rotated simultaneously with rotation of the first part 122, functioning to lift the electrical potential sensor unit 200.

When the cover 80 is further pulled upward, as shown in FIG. 6, the cover 80 is completely opened upward, and the electrical potential sensor unit 200 is completely lifted to the space next to the light scanning device 70. In this way, the developing device 60 may be ready for separation from the body 5 in the direction "K." In this case, since the electrical potential sensor unit 200 is completely lifted to the space next to the light scanning device 70, there occurs no positional interference or collision between the electrical potential sensor unit 200 and the developing device 60 despite movement of the developing device 60. That is, the electrical potential sensor unit 200 escapes from a movement path of the developing device 60, having no positional interference with the developing device 60.

The link device 100 serves as an anti-interference device to prevent positional interference between the developing device 60 and the electrical potential sensor unit 200 during installation or separation of the developing device 60.

As described above, realizing the movement of the electrical potential sensor unit 200 in association with the opening/closing movement of the cover 80 according to an embodiment of the present disclosure may result in an unobstructed installation and separation of the developing device 60 into and from the image forming apparatus.

As can be readily appreciated from the above description, in comparison to a conventional developing device, with the above described configuration according to an embodiment of the present disclosure, the interference between the developing device 60 and the electrical potential sensor unit 200 during the installation or the separation of the developing device 60 may be avoided simply by the opening/closing of the cover 80 without requiring a separate manual operation to rearrange and/or reposition the electrical potential sensor out of the installation/separation path of the developing device.

While the disclosure has been particularly shown and described with reference to several embodiments thereof with particular details, it will be apparent to one of ordinary skill in the art that various changes may be made to these embodiments without departing from the principles and spirit of the disclosure, the scope of which is defined in the following claims and their equivalents.

What is claimed is:

1. An image forming apparatus, comprising:

a body;

a developing device separably received in the body, the developing device including a photosensitive body;

an electrical potential sensor unit arranged to measure an electrical potential of a surface of the photosensitive body; and a cover arranged to open and close an access opening provided in the body through which access opening the developing device is received into and separated from the body, wherein the electrical potential sensor unit is movable in association with opening/closing movement of the cover.

2. The image forming apparatus according to claim 1, further comprising a link device that couples the cover and the electrical potential sensor unit to each other, the link device being rotatable according to the opening/closing movement of the cover.

3. The image forming apparatus according to claim 2, wherein the link device includes a first link member coupled to the cover and a second link member having one end thereof coupled to the first link member and the other end thereof coupled to the electrical potential sensor unit, the second link member being rotatable about a spatial position inside the body.

4. The image forming apparatus according to claim 3, wherein the link device includes a first hinge rotatably coupling one end of the first link member to the cover, a second hinge rotatably coupling the other end of the first link member to one end of the second link member and a third hinge rotatably coupling a portion of the second link member to the spatial position inside the body.

5. The image forming apparatus according to claim 3, wherein the first link member includes a first bent portion adjacent the spatial position inside the body.

6. The image forming apparatus according to claim 4, wherein the second link member includes a second bent portion, the third hinge being coupled to the second bent portion.

7. The image forming apparatus according to claim 6, wherein the second link member includes a first extension extending from the second hinge to the bent portion and a second extension extending from the bent portion to the electrical potential sensor unit, the first extension being shorter in length than the second extension.

8. The image forming apparatus according to claim 7, wherein the second extension includes an access portion protruding from an end thereof toward the photosensitive body, the electrical potential sensor unit being coupled to the access portion.

9. The image forming apparatus according to claim 1, wherein the cover is arranged at an upper front portion of the body, image forming apparatus further comprising a fourth hinge rotatably coupling the cover to the body.

10. The image forming apparatus according to claim 1, wherein the electrical potential sensor unit includes a sensor configured to measure the electrical potential of the surface of the photosensitive body and an electrical potential sensor housing coupled to the second link member, the sensor being receive in, and supported by, the electrical potential sensor housing.

11. The image forming apparatus according to claim 2, wherein the link device is arranged adjacent a light scanning unit configured to produce light to be incident upon the surface of the photosensitive body.

12. An image forming apparatus, comprising:

a body;

a photosensitive body having a surface on which an electrostatic latent image is to be formed and developed;

a developing device detachably received in the body, the developing device being configured to supply developer to the photosensitive body so as to develop the electrostatic latent image on the surface of the photosensitive body;

an electrical potential sensor unit arranged to measure an electrical potential of a surface of the photosensitive body; and an anti-interference device adapted to cause the electrical potential sensor unit to move out of a movement path of the developing device along which the developing device moves during installation or detachment of the developing device to thereby prevent an interfering contact between the developing device and the electrical potential sensor unit during movement of the developing device along the movement path.

13. The image forming apparatus according to claim 12, further comprising a cover arranged to open and close an access opening provided in the body through which access opening the developing device is installed into and detached from the body, wherein the anti-interference device couples the cover and the electrical potential sensor unit together in such a manner the electrical potential sensor unit moves in association with the opening/closing movement of the cover.

14. The image forming apparatus according to claim 13, wherein the anti-interference device comprises a link device that rotates in association with the opening/closing movement of the cover.

15. An image forming apparatus, comprising:

a body;

a cover arranged to open and close an access opening in the body;

a developing device having a photosensitive body, the developing device being receivable into and detachable from the body through the access opening;

an electrical potential sensor unit configured to measure an electrical potential of a surface of the photosensitive body; and a link device adapted to couple the cover and the electrical potential sensor unit in such a manner the electrical potential sensor unit moves toward or away from the photosensitive body according to opening/closing movement of the cover.

16. The image forming apparatus according to claim 15, wherein the link device includes a first link member coupled to the cover and a second link member having one end thereof coupled to the first link member and the other end thereof coupled to the electrical potential sensor unit, the second link member being rotatable about a spatial position inside the body.

17. The image forming apparatus according to claim 16, wherein the link device includes a first hinge rotatably coupling one end of the first link member to the cover, a second hinge rotatably coupling the other end of the first link member to one end of the second link member and a third hinge rotatably coupling a portion of the second link member to the spatial position inside the body.

18. The image forming apparatus according to claim 17, wherein the first link member includes a first bent portion formed at a position intermediate the two ends thereof, the second link member including a second bent portion, the third hinge being coupled to the second bent portion.

19. The image forming apparatus according to claim 18, wherein the second link member includes a first extension extending from the second hinge to the second bent portion and a second extension extending from the second bent portion to the electrical potential sensor unit, the first extension being shorter in length than the second extension.

20. The image forming apparatus according to claim 19, wherein the second extension includes an access portion protruding from an end thereof toward the photosensitive body, the electrical potential sensor unit being coupled to the access portion.

* * * * *